US005394066A

United States Patent [19]

Leroux

[11] Patent Number: 5,394,066

[45] Date of Patent: Feb. 28, 1995

[54] CATHODOLUMINESCENT SCREEN INCLUDING A MATRIX SOURCE OF ELECTRONS

[75] Inventor: Thierry Leroux, Ifs, France

[73] Assignee: Commissariat a l'Energie Atomique, France

[21] Appl. No.: 19,702

[22] Filed: Feb. 19, 1993

[30] Foreign Application Priority Data

Feb. 21, 1992 [FR] France ..... 92 02043

[51] Int. Cl.[6] ..... H01J 29/70; H01J 29/72

[52] U.S. Cl. ..... 315/366; 313/422; 313/336

[58] Field of Search ..... 315/366; 313/422, 336

[56] References Cited

U.S. PATENT DOCUMENTS 5,070,282 12/1991 Epsztein ..... 315/383

FOREIGN PATENT DOCUMENTS 172089 7/1984 European Pat. Off. .

2604823 10/1986 France .

4112078 4/1990 Germany .

*Primary Examiner*—Theodore M. Blum

*Attorney, Agent, or Firm*—Burns, Doane, Swecker & Mathis

[57] ABSTRACT

The source includes columns (4) emitting electrons and lines (6) whose potential evolves up to a positive value Vl. The screen also includes at least one additional column (24) common to all the lines, means (28) to bring this additional column to a negative potential so that, irrespective of the potential of the lines it crosses, electrons may be emitted in the crossing zones, at least one additional anode (26) opposite the additional column, and means (30) to bring this additional anode to a positive potential of less than Vl. Each line is controlled by a single output transistor (32) which brings it to Vl when it is activated and disconnects it from the voltage source Vl when it is disactivated. Application for microtip screens.

6 Claims, 2 Drawing Sheets

CATHODOLUMINESCENT SCREEN INCLUDING A MATRIX SOURCE OF ELECTRONS

FIELD OF THE INVENTION

The present invention concerns a cathodoluminescent screen including a matrix source of electrons.

In particular, it may be applicable to microtip screens.

BACKGROUND OF THE INVENTION

A diagram of the principle of such screens and the way of addressing them is given in the following article to which reference is to be made:

T. LEROUX and al and entitled "Microtips Displays Addressing" SID 91 , p. 437

Moreover, this article indicates the main two drawbacks of these screens which are due to:

- the use of high line voltages incurring high costs for line scanning circuits, and
- the high line/column capacity due to the structure of these screens.

Given the fact that on each line this capacity may be loaded and unloaded at the control voltage of the columns Vc, the resultant consumption is given by the following formula:

$$W = C \times Vc^2 \times Fl$$

where W is the consumption per $dm^2$, C is the capacity per $dm^2$ (about 30 $pF/mm^2$), Vc is the column control voltage (modulation voltage of the column signals, namely about between 30 and 40 V), and Fl is the line scanning frequency (Tl=1/Fl is the selection time of one line and Fl is between 15 and 30 kHz).

Having regard to the values given above, this consumption W may reach about between 5 and 15 $W/dm^2$.

SUMMARY OF THE INVENTION

The object of the present invention is to resolve the above-mentioned drawbacks.

It concerns a cathodoluminescent screen including a matrix source of electrons and, opposite the latter, a cathodoluminescent anode, the matrix source of electrons including:

- first parallel electrodes known as lines playing the role of grids electrically isolated from the columns and forming an angle with the latter, and
- line control means provided so as to have the potential of the latter evolve up to a positive value Vl, said screen being characterized in that it further includes:
- at least one additional electrode known as a zeroized column parallel to the columns and common to all the lines and also forming a cathodic conductor able to emit electrons,
- means for controlling this zeroized column and able to bring the latter to a negative potential so that, irrespective of the potential of the lines this zeroized column crosses, electrons may be emitted in the crossing zones,
- at least one additional anode known as a control anode and placed opposite the zeroized column, and
- means for polarizing this control anode and able to bring the latter to a potential Vac lower than Vl, and wherein the line control means include for each line a single output transistor provided to bring the corresponding line to the potential Vc when this transistor is activated and to disconnect this line from the voltage source Vl when this transistor is disactivated.

So as to improve the efficiency of the zeroized column, the control anode is preferably coated with an electron multiplier material (material with secondary emission coefficient greater than 1, such as MgO) or a cathodoluminescent material (still called "phosphor").

So as to simplify the screen of the invention, the cathodoluminescent anode is able to extend above the zeroized column, said anode thus forming the control anode and being raised to the potential Vac during the line return time.

So as to improve the response time of the screen of the invention, said screen may include two zeroized columns on both sides of the set of columns and two control anodes respectively placed opposite these zeroized columns on both sides of the cathodoluminscent anode.

Finally, the screen of the invention may be a microtip screen and, in this case, the columns, including each zeroized column, bear in the column and line crossing zones a number of microtips made of an electron emitting material.

BRIEF DESCRIPTION OF THE DRAWINGS

The present invention shall be more readily understood from a reading of the following explanatory non-restrictive embodiment examples with reference to the accompanying drawings on which.

DETAILED DESCRIPTION OF THE PREFERRED EMBODIMENTS

Figure 1:
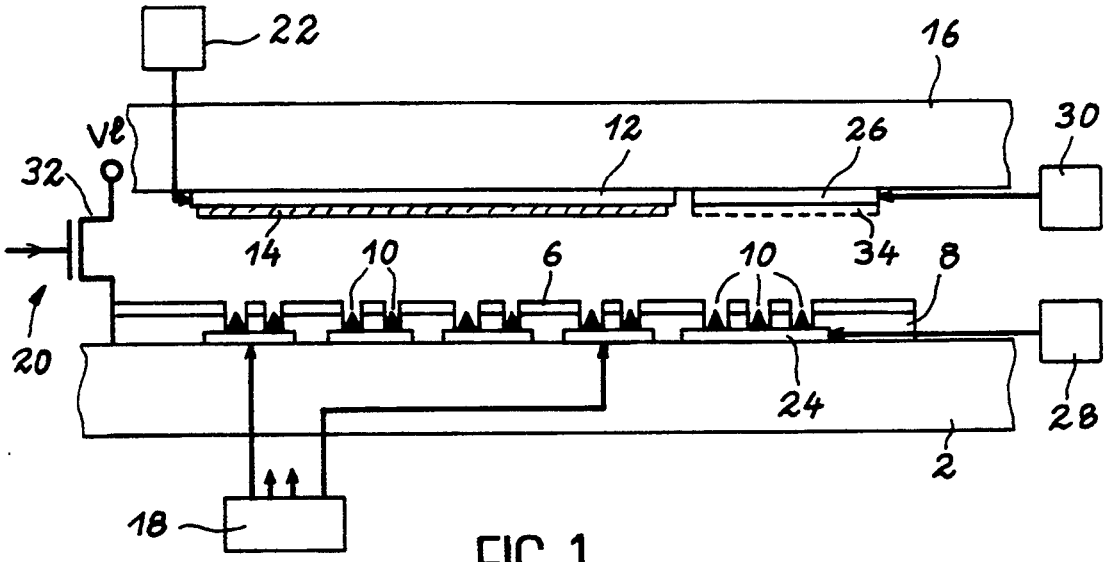
FIG. 1 is a diagrammatic cutaway partial view of one particular embodiment of the screen of the invention.

The screen of the invention, diagrammatically shown on FIG. 1, conventionally includes a substrate 2 on which parallel electrodes, known as columns 4, are formed.

Other parallel electrodes playing the role of grids and known as lines, such as the line 6 where the screen of FIG. 1 is shown cutaway, are placed above the columns perpendicular to the latter and are separated from them by an electrically nonconducting film 8.

In the example shown on FIG. 1, this concerns a microtip screen and the columns bear the microtips 10 made of an electron emitter material in the zones where these columns and lines "cross".

The nonconducting film 8 and the lines 6 are pierced opposite these microtips.

The screen of FIG. 1 also comprises, opposite the matrix formed by the lines and columns, a display anode 12 which is transparent and coated with a film of "phosphor" 14.

This display anode 12 or cathodoluminescent anode is formed on the internal face of a transparent plate and being electrically nonconducting 16 and made of glass, for example, and separated from the substrate 2 bearing the lines and columns and a vacuum is made in the space separating the plate from the substrate.

FIG. 1 also shows means 18 for controlling the columns 4, one portion of the means 20 for controlling the lines 6 and means 22 for polarizing the cathodoluminescent anode 12.

This figure also shows the screen of the invention including, in addition to the conventional components described above, an additional zone appearing in the righthand portion of said figure and which does not take an active part in the displaying of images.

This additional zone includes:

an additional electrode 24 forming a pseudo-column parallel to the other columns and common to all the lines 6 and known as a "zeroizing column" also bearing microtips 10 in the zones where it crosses the lines, and another electrode 26 forming a pseudo-anode formed on the plate beside the cathodoluminescent anode 12 and opposite the zeroizing column 24.

Furthermore, the screen of FIG. 1 includes means 28 for controlling the zeroizing column 24 and provided to bring the latter to a negative potential $-Vr(Vr>0)$ so that, regardless of the potential of the lines this zeroizing column crosses, electrons are able to be emitted in the crossing zones.

It ought to be mentioned that in known types of screens, the potential of the lines evolves between 0 and a positive value Vl.

The screen of FIG. 1 also includes means 30 for polarizing the electrode 26 known as the control anode, said means being able to raise the latter to a potential Vac.

In the screen of FIG. 1, the means 20 used for control of the lines only includes for each line 6 a single output transistor 32, whereas known types of screen include two transistors.

This sole output transistor 32 is provided to bring the line with which it is associated to the potential Vl when this transistor is activated and to disconnect this line 6 when it is disactivated.

This known type of circuit is usually called an "open drain circuit" (when the transistor is a field effect transistor, this being the case on FIG. 1) or an "open collector circuit" (when the transistor is a bipolar transistor).

Up until now, this type of circuit could not be used for microtip screens.

Its use in the present invention is rendered possible by the use of the zeroizing column 24 and the control anode 26.

Figure 2:
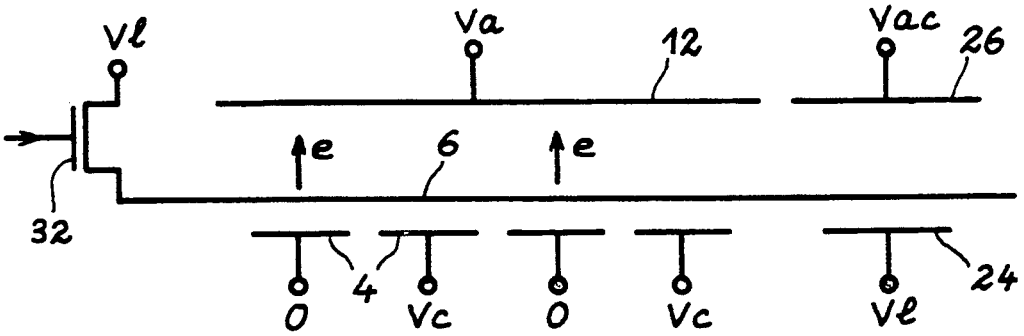
FIG. 2 is an electric diagram showing a selected line of the screen shown on FIG. 1.
Figure 3:
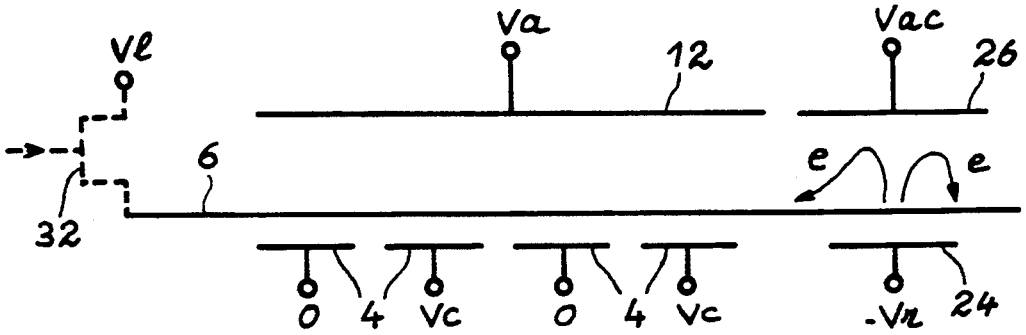
FIG. 3 is an electric diagram showing one line of this screen in the course of deselection.

With reference now to FIGS. 2 and 3, there follows a description of the functioning of the screen shown on FIG. 1 by considering first of all the selection of one line of this screen (FIG. 2) and then deselection of this line (FIG. 3).

FIG. 2 shows a selected line 6.

This line is brought to the potential Vl by its control transistor 32.

Depending on whether the potential of the columns 4 equals 0 or Vc ($Vc>Vl$), electrons may or may not be emitted in the zones where these columns cross the line in question.

The emitted electrons are then accelerated towards the cathodoluminescent anode 12 by virtue of the positive potential Va to which this anode is raised ($Va>Vl$) and strike the cathodoluminescent material 14 whose anode 12 is coated and form the image to be displayed.

The zeroizing column 24 does not play any active role during line selection and may be raised to the positive potential Vl, for example.

FIG. 3 shows the line 6 during deselection.

This line 6 is left free to evolve towards any potential and independent of Vl due to the fact of the blocking of its control transistor 32.

The zeroizing column is brought to the potential $-Vr$ and the control anode 26 is brought to the potential Vac which is lower than Vl and as such able to ensure blocking of the emission of electrons if it were directly applied to the line 6.

The electrons emitted on crossing of the zeroizing column and the various lines, due to the greater potential of these lines, are attracted by the previously selected lines which, owing to this, shall progressively discharge up to the potential Vac.

Thus, it can be seen that conventional functioning (line selection and deselection) is reproduced in the present invention except that in the latter the potential of the lines evolves between Vac and Vl.

Furthermore, the invention offers the following advantages:

reduction of the complexity of the line control circuits (at least from a factor 2) and accordingly a reduction of the cost of these circuits, reduction of the power consumed by the biais of the creation of floating electrodes (namely, the lines forming grids) in the screen.

In fact, the capacities of the columns, that is capacities which conventionally are all in parallel, may be in series in the present invention, hence resulting in a reduction of the equivalent capacity and thus the consumed power.

So as to improve the efficiency of the zeroizing column 24, it is preferable to coat the control anode 26 with an electron multiplier material, such as MgO, or with "phosphor" 34.

Figure 4:
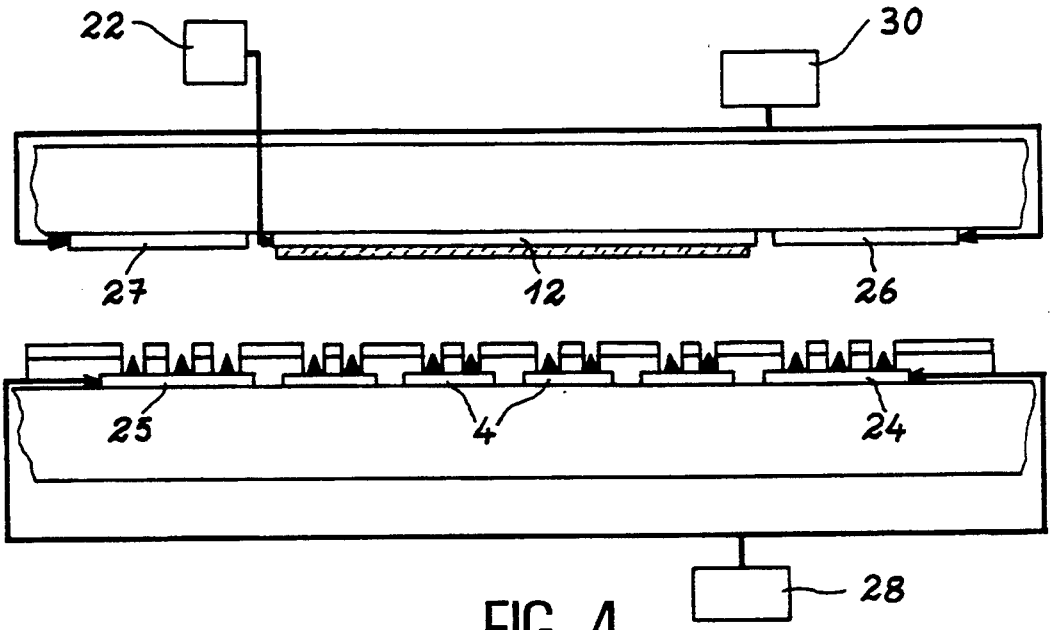
FIG. 4 is a diagrammatic partial view of a screen conforming to the invention and including two zeroized columns and two control anodes respectively opposite these zeroized columns.

In another particular embodiment of the invention diagrammatically and partly shown on FIG. 4, two zeroizing columns are used respectively placed on both sides of the set of lines and columns, and two control anodes respectively placed on both sides of the cathodoluminescent anode and opposite these zeroizing columns.

In this case, as shown on FIG. 4, in addition to the zeroizing column 24 and the control anode 26 (right portion of FIGS. 1 and 4), the screen comprises another zeroizing column 25 identical to the column 24 but situated in the left portion of the screen and, in addition to the control anode 26, the screen comprises another control anode 27 identical to the anode 26 but placed opposite the zeroizing column 25.

The means 28 then control the two columns 24 and 25 and the means 30 control the two anodes 26 and 27.

Thus, the screen response time is improved.

So as to simplify the screen, the display anode 12, coated with a cathodoluminescent material 14 and used to form the image and raised during the active period of the line time to the potential Va, may be used during the line return time as a control anode, thus raising this display anode to the potential Vac.

Figure 5:
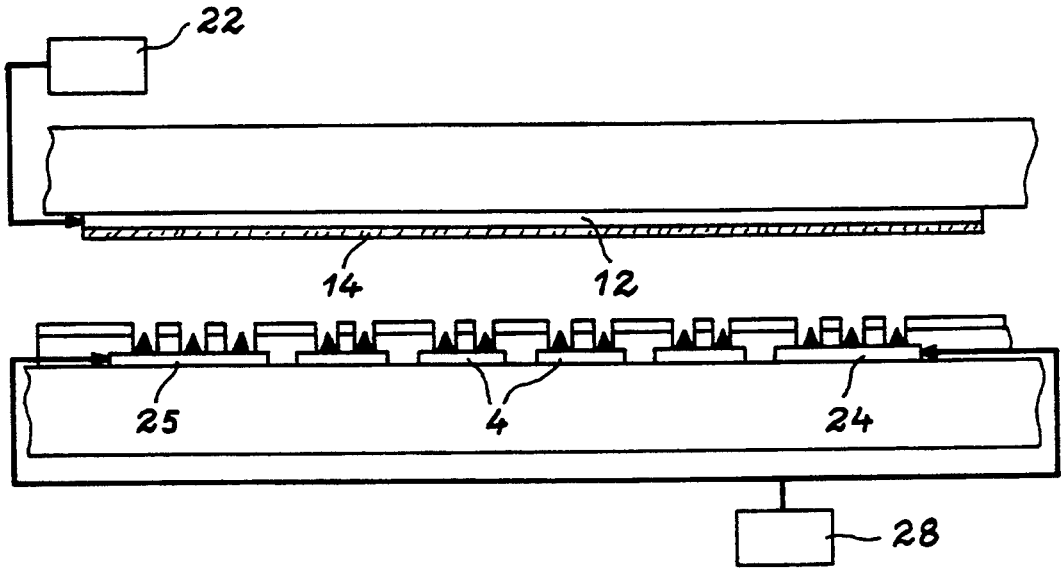
FIG. 5 is a partial diagrammatic view of another screen conforming to the invention in which the cathodoluminescent anode also forms the control anode(s).

In this case, this display anode extends above the zeroizing column 24 as shown on FIG. 5 and then constitutes the control anode and, if there is another zeroizing column, the display anode also extends above this other zeroizing column (case of FIG. 5) and then constitutes the other control anode.

What is claimed is:

1. A cathodoluminescent screen including an electron matrix source and an opposing cathodoluminescent anode, the electron matrix source including:

first parallel electrodes defining columns which form cathodic conductors associated with microtips for emitting electrons, second parallel electrodes defining rows which form grids that are electrically insulated from the columns and that are at an angle with the latter, wherein areas in which the rows and the columns cross form a first set of crossing zones, and row control means for making the potential of the rows evolve up to a positive value Vl, wherein the screen further includes:

at least one additional electrode defining a zeroizing column parallel to the other columns and crossing all of the rows, the areas in which the rows and the zeroizing column Cross forming a second set of crossing zones, the zeroizing column also forming a cathodic conductor associated with microtips for emitting electrons, means for controlling the zeroizing column and for bringing said zeroizing column to a negative potential so that, regardless of the potential of the rows crossed by this zeroizing column, electrons may be emitted in the second set of crossing zones of the zeroizing column and rows, at least one additional anode defining a control anode located opposite the zeroizing column, and means for polarizing the control anode and for raising the latter to a potential Vac that is lower than Vl, and wherein the row control means includes a single corresponding output transistor for each row which is provided to raise each row to the potential Vl when its corresponding transistor is activated and to disconnect each row from the potential source Vl when its corresponding transistor is deactivated.

2. A screen according to claim 1, wherein the control anode is coated with an electron multiplier material.

3. A screen according to claim 1, wherein the cathodoluminescent anode extends above the zeroizing column, the cathodoluminescent anode functioning as the control anode when being raised to the potential Vac.

4. A screen according to claim 1, including two zeroizing columns on both sides of the columns and two control anodes respectively placed opposite the two zeroizing columns on both sides of the cathodoluminescent anode.

5. A screen according to claim 1, wherein the columns, including each zeroizing column, bear microtips in the first and second sets of crossing zones, said microtips being made of an electron emitting material.

6. A screen according to claim 1, wherein the control anode is coated with a cathodoluminescent material.

* * * * *